US005880398A

United States Patent [19]

Crilly et al.

[11] Patent Number: 5,880,398

[45] Date of Patent: Mar. 9, 1999

[54] DUAL-PURPOSE BULLET

[75] Inventors: Michael Gerard Crilly, Hatboro; Maurice Edward Grudza, Langhorne; David Charles Jann, Bensalem, all of Pa.; Hugh Harper Gibbs, Wilmington, Del.

[73] Assignee: Scientific Solutions Inc., Hatboro, Pa.

[21] Appl. No.: 915,420

[22] Filed: Aug. 20, 1997

[51] Int. Cl.[6] ..... F42B 12/00

[52] U.S. Cl. ..... 102/501; 102/364; 102/502; 102/473; 244/3.23

[58] Field of Search ..... 102/364, 439, 102/448, 501, 502, 513–518, 529, 473, 498, 395; 244/3.23

[56] References Cited

U.S. PATENT DOCUMENTS

| | | | |
|---|---|---|---|
| 3,170,405 | 2/1965 | Jungermann et al. | 102/529 |
| 3,785,293 | 1/1974 | Barr et al. | 102/529 |
| 3,861,311 | 1/1975 | Bilsbury . | |
| 3,935,816 | 2/1976 | Boquette, Jr. | 102/515 |
| 3,952,662 | 4/1976 | Greenlees . | |
| 4,742,776 | 5/1988 | Scuto | 244/3.23 |
| 5,009,164 | 4/1991 | Grinberg | 102/501 |
| 5,214,237 | 5/1993 | Mc Arthur . | |
| 5,295,439 | 3/1994 | Carbone . | |
| 5,454,325 | 10/1994 | LeBlanc . | |

FOREIGN PATENT DOCUMENTS

| | | | |
|---|---|---|---|
| 2284855 | 9/1974 | France | 244/3.23 |

*Primary Examiner*—Harold J. Tudor

[57] ABSTRACT

A dual-purpose bullet is provided consisting of a thermoplastic body, a base cap, and a pressed powder core. The bullet in the preferred embodiment can either penetrate destroying and disrupting large volumes of human tissue or not penetrate the human tissue delivering a strong shock event and creating a thermal nuisance. The lethal mode is achieved by a high-velocity launch of the bullet without ignition of the igniter mixture and pressed powder core. The less-than-lethal mode is achieved by a low-velocity launch with ignition of first the pressed powder core and softening of the plastic projectile body.

3 Claims, 1 Drawing Sheet

DUAL-PURPOSE BULLET

GOVERNMENT LICENSE RIGHTS

The United States Government has a paid-up license in this invention and the right in limited circumstances to require the patent owner to license others on reasonable terms as provided for by the terms of DAAE30-97-C-0001 awarded by the Department of Army.

CROSS REFERENCES TO RELATED APPLICATIONS

No related applications.

FIELD OF INVENTION

This invention concerns a bullet which can be either lethal or less-than-lethal.

BACKGROUND OF THE INVENTION

Bullet technology falls into two general categories: (1) lethal bullets and projectiles launched at high velocity, typically greater than 300 meters-per-second, usually consisting of metallic materials, and (2) less-than-lethal bullets and projectiles launched at low velocity, typically less than 150 meters-per-second, usually consisting of non-metallic materials. Bullet design maximizes the desired effects within a specific category, thus precluding applicability to the other. The distinction between lethal and less-than-lethal bullets creates severe deficiencies in two respects. First, less-than-lethal bullets are typically incompatible with weapons designed to fire lethal ammunition. Second, single-purpose lethal and less-than-lethal bullets impose a fixed level of response on the user irrespective of the threat or situation.

Lethal bullets achieve the desired effect by penetration of the opponent thus creating a primary cavity of destroyed human tissue and a secondary volume of disrupted human tissue. The extent of destroyed and disrupted human tissue is optimized through a combination of bullet velocity, material, and design. Non-metallic bullets have been occasionally invented and used to achieve lethal effects. Typically, plastic bullets are inherently limited in terms of penetration capability thus yielding a small volume of destroyed human tissue, a small volume of disrupted human tissue, or both.

McArthur U.S. Pat. No. 5,214,237, 1993 teaches a plastic bullet composed of the plastic polytetrafluoroethylene (sold under the tradename "Teflon" by DuPont) which produces large volumes of destroyed and disrupted human tissue by projecting a small mass of plastic at high velocity. The combination of low bullet mass and design provides for limited aerostability. This concept is designed to optimize lethality by trading off a portion of the bullet's limited penetration capability for increased tissue damage. The exclusive use of plastic precludes the disorientation effectiveness (i.e., shock effect) of this low mass bullet.

LeBlanc U.S. Pat. No. 5,454,325, 1995 teaches a projectile consisting of a metal jacket with a core of thermoplastic and lead shot. The projectile expands on impact with a soft material, yet is capable of penetrating hard material. This application of a lead core surrounded by a copper jacket limits its utility to lethal effects. The dual-purpose bullet avoids the lethality associated with the application of a metal core by surrounding the pressed powder with a thermoplastic jacket.

Bilsbury U.S. Pat. No. 3,861,311, 1975 teaches a combination of a plastic bullet with an incendiary material so as to create an armor piercing bullet which utilizes a plastic jacket which ruptures on impact enabling a metal penetrator to pierce the target. This invention is distinguished from the dual-purpose bullet in that the plastic jacket in the former invention is not required for penetration. The dual-purpose bullet employs the plastic body and pressed powder core to act in conjunction to provide the lethal effects of tissue destruction and disruption.

Less-than-lethal ammunition achieves the desired effect by disorienting the opponent. This effect is achieved by inducing a non-penetrating, shock event that propagates into the area surrounding the impact. Human tissue destruction is avoided. Human tissue disruption is minimized. Generally, less-than-lethal ammunition reduces mortality by decreasing projectile density, decreasing material strength, decreasing velocity, and increasing projectile diameter.

One such shock effects projectile is contained in Greenlees U.S. Pat. No. 3,952,662, 1976. The projectile is fired from a conventional shotgun comprising a pliant body of flexible arms after exiting the gun muzzle. The increased impact area prevents penetration of the projectile into the target. The projectile is limited in that the flexible arms are incompatible with the high-velocity launch, the flight dynamics, and the penetration required of lethal rounds.

A second shock-effects projectile is described in Carbone U.S. Pat. No. 5,295,439, 1994. The projectile consists of successive cylindrical slugs which are launched and provide multiple impacts on the target. This concept is limited in that its dispersed nature eliminates the focused mass required for lethal penetration and human tissue destruction.

As is apparent from the inventions above, none provide a single round which possesses the penetration capacity for lethality, the non-penetration capability for less-than-lethal impacts coupled with an effective disorientation feature, and the flight stability required of lethal bullets for engaging targets at extended ranges.

It is therefore the primary object of this invention to provide a bullet that:

A. Provides a single bullet design with lethal capability when fired at high velocity and less-than-lethal capability when fired at low velocity.

B. Provides a lethal capability through the combined response of a plastic body and a pressed powder core.

C. Provides a less-than-lethal capability producing disorientation and a nuisance effect through the combined response of a pressed powder core and a softened plastic body.

D. Provides flight stability through the combination of projectile shape, weight, and flutes which is compatible with both lethal and less-than-lethal modes of operation.

SUMMARY OF THE INVENTION

The bullet consists of a plastic body and base cap surrounding a pressed powder core. A cavity in the base cap and pressed powder core contains an igniter mixture. When fired at high velocity, the pressed metal core is not ignited thus retaining its original form and brittleness. Upon impact, the plastic body and pressed powder core penetrate and deform thereby increasing both destroyed and disrupted human tissue. When fired at low velocity, the pressed powder core is ignited, subsequently hardening the pressed powder core and softening the plastic body and base cap. The hardened pressed powder core provides rigidity for the plastic as it softens to retain flight stability at low velocity and creates a non-penetrating shock event. The softened plastic body imparts a thermal nuisance event.

REFERENCE NUMERALS

Figure 1:
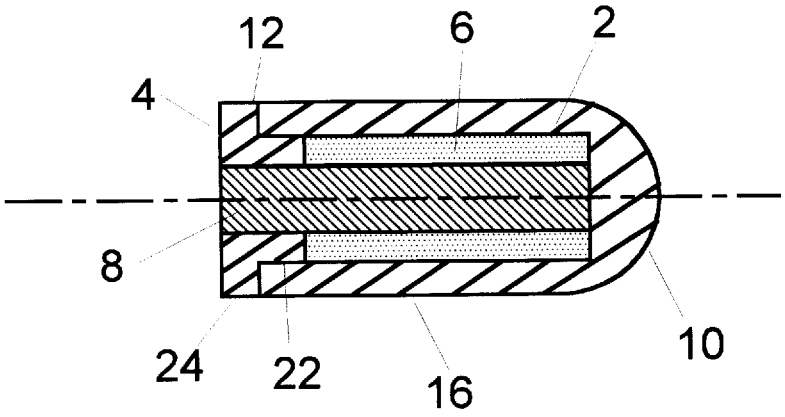
FIG. 1. Cross section of bullet along its longitudinal axis.

2 Projectile body
4 Base cap
6 Pressed powder core
8 Igniter mixture
10 Hemispherical end
12 Open end
16 Cylindrical body
20 Helical flutes
22 Minor diameter end
24 Major diameter end

DESCRIPTION OF THE INVENTION

Figure 2:
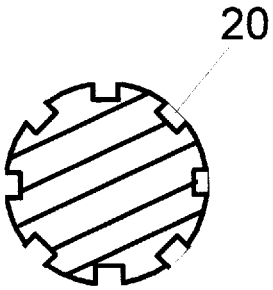
FIG. 2. View of front end showing helical flutes.
Figure 3:
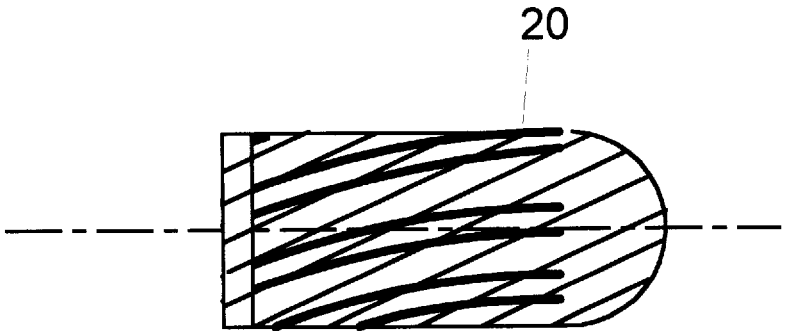
FIG. 3. Side view showing helical flutes.

FIG. 1 shows the dual-purpose bullet and its components. FIG. 2 shows a frontal view of the bullet and the helical flutes 20. FIG. 3 shows a side view of the bullet and the helical flutes. The bullet consists of a projectile body 2, a pressed powder core 6, a base cap 4, and an igniter mixture 8.

The projectile body 2 is a single-piece unit consisting of a thermoplastic with a hemispherical end 10, a flat end 12, and a cylindrical body 16. The projectile body surrounds the pressed powder core 6, provides the deformation required to maximize the volume of destroyed and disrupted human tissue in the lethal mode, and provides a source of readily deformable, hot material which acts as a nuisance in the less-than-lethal mode. In general, thermoplastics compatible with this design include melt processible thermoplastics which are extrudable or injection moldable. The preferred invention includes polytetrafluoroethylene copolymers, polyetherimides, polyamides, polyetheretherketones, polyethylenes, ethylene/hexene copolymers, and thermoplastic polyester elastomers. The most preferred invention includes polytetrafluoroethylene copolymer Teflon PFA 340 (DuPont), the polyamide Zytel 158L 612 (DuPont), the ethylene/hexene copolymer Marlex HHM 4550 (Phillips Petroleum), and the thermoplastic polyester elastomer Hytrel 4556 (DuPont). These plastics are sufficiently strong and tough to survive gun launch.

A series of helical flutes 20 lie along the circumferential length of the cylindrical body 16. The preferred orientation of the helical flutes 20 is 11 degrees with respect to the longitudinal axis of the projectile body 2. A cavity lies along the longitudinal axis of the cylindrical body 16. The open end 12 of this cavity accommodates and secures the base cap 4 to the projectile body 2. Fabrication of the projectile body 2 is by methods known to those skilled in the art of machining and injection molding.

The base cap 4 is composed of a thermoplastic with a minor diameter end 22 and a major diameter end 24. The base cap 4 supports the pressed powder core 6 during acceleration and prevents its ejection upon impact and immediately thereafter. The minor diameter end 22 communicates with the open end of the projectile body 2. The preferred and most preferred resins noted for the projectile body 2 are applicable to the base cap 4. The longitudinal axis of the base cap is drilled to form a hole. The length of the minor diameter end 22 is sufficient to insure intimate contact between the base cap 4 and the pressed powder core 6. Fabrication of the base cap 4 is by methods known to those skilled in the art of machining and injection molding.

The pressed powder core 6 consists of a metal powder system which, when compacted, forms a brittle solid. The intermetallic metal powder system, when ignited by the igniter mixture 8, generates a gas-less, exothermic event sufficient to soften the projectile body 2 and base cap 4. The pressed powder core 6 is cylindrical in cross-section with a cavity along its longitudinal axis. This shape is achieved by compacting loose powder into the cavity within the projectile body 2 under pressures exceeding 5,000 psi. Compaction methods are those known to those skilled in the art. Metal powder systems compatible with this invention produce a hardened mass after reaction. The preferred invention includes powder systems with heats of reaction greater than 1000 calories-per-gram selected from the family of intermetallic reactions with boron as one of two primary components. The most preferred invention is tantalum diboride. This mixture is prepared by conventional mixing techniques by blending 1 to 5 micron tantalum powder with amorphous boron with a 1 micron average particle size and purity greater than 95%. This mixture consists of one mole tantalum to two moles boron. The cylindrical cavity is of sufficient diameter to accommodate the igniter mixture mass required to initiate the exothermic event.

The igniter mixture 8 is either a loose or solid composition with sufficient thermal output to rapidly raise the pressed powder core above its reaction threshold temperature. The igniter mixture 8 must be sufficiently sensitive to ignition by conventional gunpowder, yet insensitive to initiation when shielded from the gun powder and subjected to acceleration forces in excess of 25,000 g's. The igniter mixture 8 fills the cavity in the pressed powder core 6 and base cap 4. The preferred invention has a reaction rate in excess of 0.66 meters-per-second and a heat of reaction above 500 calories-per-gram. The most preferred igniter mixture is polytetrafluoroethylene and aluminum in a mass ratio of 72.5% and 26.5%, respectively.

The following dimensions exemplify one set of dimensions suitable for a dual-purpose bullet usable in a 12-gauge, smoothbore shotgun. All dimensions are provided in millimeters.

TABLE 1

Example dimensions.

| Component | Length (mm) | Outer Diameter (mm) | Inner Diameter (mm) |
|---|---|---|---|
| 2 Projectile body | 41.275 | 18.288 | 12.294 |
| 4 Base cap | 9.525 | — | — |
| 6 Pressed powder core | 25.400 | 12.294 | 6.350 |
| 8 Igniter mixture | 34.925 | 6.350 | — |
| 10 Hemispherical end | 12.700 | 18.288 | — |
| 12 Open end | — | 18.288 | 12.294 |
| 16 Cylindrical body | 31.750 | 18.288 | 12.294 |
| 20 Helical flutes | 31.750 | 18.288 | 15.748 |
| 22 Minor diameter end | 6.350 | 12.294 | 6.350 |
| 24 Major diameter end | 3.175 | 18.288 | 6.350 |

Operation

When fired in the lethal mode, the bullet is projected from the gun at a velocity in excess of 300 meters-per-second, the igniter mixture 8 remains unreacted, and the pressed powder core 6 is not ignited. The result is a high-velocity mass of plastic and a brittle pressed powder core 6 with sufficient penetration capability to perforate clothing and human tissue. The plastic and core deform, mushroom, and fracture during penetration.

When fired in the less-than-lethal mode, the bullet is projected from the gun at a velocity less than 155 meters-per-second, the igniter mixture 8 is initiated, and the pressed powder core 6 is ignited. The result is a low-velocity mass of softened plastic and pressed powder with reduced human tissue penetration capability. The reacted pressed powder core 6 forms a hardened mass which increases the impact shock effect. The hardened pressed powder core provides rigidity for the plastic as it softens to retain flight stability at low velocity. The thermal energy released by the pressed powder core 6 and absorbed by the projectile body 2 and base cap 4 softens the material. This softened material contacts the target thereby elevating the temperature on that portion of the target.

INDUSTRIAL APPLICABILITY

Accordingly, it can be seen that the invention facilitates a dual level of response by law enforcement or military personnel against hostile threats. In the lethal mode, the bullet penetrates and deforms yielding both large volumes of destroyed and disrupted human tissue. In the less-than-lethal mode, the bullet is non-penetrating yielding both shock and thermal effects. The primary advantage of this invention is its ability to achieve both modes within a single bullet design. Also it is important to note that the bullet is compatible with currently available weapons designed to fire lethal bullets and projectiles. The concept is ideally suited to smoothbore, 12-gauge shotguns.

Although the description above contains many specificities, these should not be construed as limiting the scope of the invention but as merely providing illustrations of some of the presently preferred embodiments of this invention. Various other embodiments and ramifications are possible. For example, the bullet could be integrated into a cartridge which allows the user to select the desired mode. Alternately, the bullet could be loaded into a single-purpose cartridge thus achieving either a lethal or a less-than-lethal effect. Furthermore, the bullet could be used where the selection is provided in the weapon.

Thus the scope of the invention should be determined by the appended claims and their legal equivalents, rather than by the examples given.

What is claimed is:

1. A dual-purpose bullet, for lethal and less-than-lethal effects, comprising:

(a) a projectile body, said projectile body formed of a thermoplastic, said projectile body having a hemispherical end and an open end, said projectile body having a cylindrical body and a plurality of helical flutes, said projectile body having a cavity along its longitudinal axis, said helical flutes located along the circumference of said cylindrical body and of smaller diameter than said cylindrical body;

(b) a base cap, said base cap formed of a thermoplastic, said base cap having a minor diameter end and a major diameter end, said minor diameter end communicates and secures to said open end of said projectile body, said major diameter end of same diameter as said cylindrical body of said projectile body, said base cap having a cavity along its longitudinal axis;

(c) a pressed powder core, said pressed powder core is an intermetallic mixture, said pressed powder core of circular cross section including a cavity along its longitudinal axis, said pressed powder core is pressed into said cylindrical cavity of said projectile body with pressures exceeding 5,000 psi, said pressed powder core contacts said base cap; and (d) an igniter mixture, said igniter mixture produces sufficient thermal output to rapidly raise said pressed powder core above its reaction threshold temperature, said igniter mixture must be sufficiently sensitive to ignition by conventional gunpowder, said igniter mixture having a length along its longitudinal axis such that said pressed powder core and said base cap contact said igniter mixture along its circumference.

2. The dual-purpose bullet of claim 1 wherein (a) said projectile body and said base cap are selected from the group consisting of polytetrafluoroethylene copolymers, polyetherimides, polyamides, polyetheretherketones, polyethylenes, ethylene/hexene copolymers, and thermoplastic polyester elastomers, said helical flutes at 11 degrees with respect to the longitudinal axis of said projectile body; and (b) said igniter mixture must have a linear reaction rate in excess of 0.66 meters-per-second and a heat of reaction above 500 calories-per-gram.

3. The dual-purpose bullet of claim 1 wherein said pressed powder core is tantalum diboride consisting of 1 to 5 micron tantalum and amorphous boron with a 1 micron average particle size and purity greater than 95%, and present in the ratio of one mole tantalum and two moles boron.

* * * * *